US010718076B2

(12) United States Patent
Weigert et al.

(10) Patent No.: US 10,718,076 B2
(45) Date of Patent: Jul. 21, 2020

(54) PLANT AND METHOD FOR CONNECTING A WEB OF FIBROUS MATERIAL TO A NONWOVEN OR CONSOLIDATING IT THEREWITH

(71) Applicants: TRUETZSCHLER GMBH & CO. KG, Moenchengladbach (DE); VOITH PATENT GMBH, Heidenheim (DE)

(72) Inventors: Thomas Weigert, Sulzbach (DE); Steffen Peters, Linnich (DE); Dominic Prömpler, Seligenstad (DE)

(73) Assignees: TRUETZSCHLER GMBH & CO. KG, Moenchengladbach (DE); VOITH PATENT GMBH, Heidenheim (DE)

( * ) Notice: Subject to any disclaimer, the term of this patent is extended or adjusted under 35 U.S.C. 154(b) by 193 days.

(21) Appl. No.: 15/561,975

(22) PCT Filed: Feb. 4, 2016

(86) PCT No.: PCT/EP2016/000178
§ 371 (c)(1),
(2) Date: Sep. 26, 2017

(87) PCT Pub. No.: WO2016/165798
PCT Pub. Date: Oct. 20, 2016

(65) Prior Publication Data

US 2018/0112339 A1 Apr. 26, 2018

(30) Foreign Application Priority Data

Apr. 13, 2015 (DE) ..... 10 2015 004 506
Aug. 6, 2015 (DE) ..... 10 2015 112 955

(51) Int. Cl.
*D04H 1/492* (2012.01)
*D04H 18/04* (2012.01)
*D04H 1/498* (2012.01)

(52) U.S. Cl.
CPC ..... *D04H 1/492* (2013.01); *D04H 1/498* (2013.01); *D04H 18/04* (2013.01)

(58) Field of Classification Search
CPC ..... D04H 18/04; D04H 1/492; D04H 1/498; D04H 1/465; D04H 1/49; D04H 5/03; D04H 3/11
(Continued)

(56) References Cited

U.S. PATENT DOCUMENTS 5,253,397 A * 10/1993 Neveu ..... D04H 1/492 28/105
5,761,778 A * 6/1998 Fleissner ..... D04H 1/46 28/104
(Continued)

FOREIGN PATENT DOCUMENTS

CN 1780955 B 5/2010
CN 103298990 A 9/2013
(Continued)

OTHER PUBLICATIONS

International Search Report for PCT/EP2016/000178, dated May 4, 2016, and English Translation thereof.
Written Opinion for PCT/EP2016/000178, dated May 4, 2016.

*Primary Examiner* — Amy Vanatta
(74) *Attorney, Agent, or Firm* — FisherBroyles, LLP; Robert Kinberg

(57) ABSTRACT

A plant and a method for connecting a web of fibrous material to a nonwoven or consolidating it therewith includes a first circulating belt on which the web of fibrous material is laid, a device for introducing a nonwoven into the plant, and a further successive circulating belt on which the nonwoven is to be connected to or consolidated with the web of fibrous material. The web of fibrous material from the first circulating belt is first laid on the nonwoven and subsequently the fibrous material is transferred onto the succes-
(Continued)

sive belt together with the nonwoven for connection or consolidation by use of water jets.

6 Claims, 8 Drawing Sheets

(58) Field of Classification Search
USPC ..... 28/104
See application file for complete search history.

(56) References Cited

U.S. PATENT DOCUMENTS 6,141,833 A * 11/2000 Sorensen ..... D01G 25/00 19/161.1
6,163,943 A * 12/2000 Johansson ..... D04H 1/4374 28/104
6,550,115 B1 * 4/2003 Skoog ..... D04H 1/498 28/104
7,278,187 B2 * 10/2007 Petersen ..... D04H 1/4374 19/302
2002/0168910 A1 * 11/2002 Vuillaume ..... D04H 3/11 442/381
2003/0021970 A1 1/2003 Noelle
2003/0217448 A1 * 11/2003 Andersen ..... B32B 5/26 28/104
2005/0091811 A1 * 5/2005 Billgren ..... D04H 5/02 28/104
2006/0230589 A1 * 10/2006 Christensen ..... D04H 1/492 28/117
2007/0128411 A1 * 6/2007 Kawai ..... B32B 5/08 428/170
2012/0096694 A1 * 4/2012 Muenstermainn ..... D04H 1/46 28/104
2013/0157537 A1 6/2013 Jackson et al.

FOREIGN PATENT DOCUMENTS

EP 1 929 080 B1 4/2009
EP 2 116 645 A1 11/2009
WO 2004/097097 A1 11/2004
WO 2005/118934 A1 12/2005

* cited by examiner

PLANT AND METHOD FOR CONNECTING A WEB OF FIBROUS MATERIAL TO A NONWOVEN OR CONSOLIDATING IT THEREWITH

CROSS-REFERENCE TO RELATED APPLICATIONS

This application is a U.S. National Stage of International Patent Application No. PCT/EP2016/000178 filed Feb. 4, 2016, designating the United States and claiming benefit of German Patent Application No. 10 2015 004 506.7 filed Apr. 13, 2015, and German Patent Application No. 10 2015 112 955.8, filed Aug. 6, 2015.

BACKGROUND OF THE INVENTION

The invention relates to an installation and a method for the bonding or entanglement of a web of fibre material with a nonwoven by means of water jets, having a first circulating belt, on which a web of fibre material can be deposited, and an apparatus for introducing a nonwoven into the installation, having a further downstream circulating belt on which the nonwoven and the web of fibre material can be bonded or entangled with one another by means of water jets.

It is known from EP 1929080 B1 to bond loose fibres with a nonwoven, in which the loose fibres are always supported and guided from beneath by a belt and at the same time are deposited on a nonwoven. This method and the associated installation are very complex because the belts must be guided absolutely in parallel over a relatively long portion. This is very complex to implement structurally because a constant tension is required between the belts and the two belts must have an identical speed at every point so as not to introduce uncontrolled distortions into the end product.

SUMMARY OF THE INVENTION

The object of the present invention is to provide a method and an installation for the bonding of a web of loose fibres with a nonwoven, with which a compact and inexpensive installation can be produced.

The above and other objects are achieved according to one aspect of the invention by an installation for bonding or entanglement of a web of fibres with a nonwoven, which in one embodiment comprises at least a first circulating belt, on which a web of fibre material can be deposited, and an apparatus for introducing a nonwoven into the installation, downstream of which there is arranged a further downstream circulating belt on which the nonwoven and the web of fibre material can be bonded or entangled with one another by means of water jets. The web of fibre material from the circulating belt first can be deposited on the nonwoven and then the fibre material together with the nonwoven is transferred to the downstream belt for bonding or entanglement by means of the water jets.

Very simple belt guiding is thus achieved, in which the web of fibre material and the nonwoven do not have to be brought together enclosed by a second circulating belt. Furthermore, the bonding of the fibre material with the nonwoven does not take place in a region in which two belts are guided in parallel. Unlike in the prior art, the loose fibres thus do not have to be aligned and bonded with the nonwoven upside down between two belts. Alignment of the belts with one another and synchronisation of the belt speeds are thus not necessary.

The terminology of depositing the fibre material on the nonwoven does not require the nonwoven to take an approximately horizontal position in order for the loose fibres or the web of fibre material to be transferred to the nonwoven and undergo a first bonding. It is sufficient that a first contact between the nonwoven and the web of fibre material is established on e.g. the descending sloping portion of the circulating belt, so that the adhesion between the layers effects a first low degree of bonding even when the nonwoven is arranged spatially above the fibre material.

Bonding between the nonwoven and the fibre material takes place by means of water jets, entanglement of the fibre material within itself but also with the nonwoven taking place at the same time because the fibres intermingle and twist. In this connection, bonding of the nonwoven and the fibre material also means entanglement at the same time.

According to one embodiment, an installation for bonding or entanglement of a web of fibres with a nonwoven, comprises: a first circulating belt arranged for depositing a web of fibre material thereon, the web of fibre material having an upper side remote from the first circulating belt; a second circulating belt arranged downstream of the first circulating belt for receiving the web of fibre material with the upper sided facing the second circulating belt; a third circulating belt arranged downstream of the second circulating belt; an apparatus for introducing a nonwoven into the installation arranged between the second and third circulating belts; wherein the second circulating belt and the apparatus for introducing the nonwoven are arranged so that the web of fibre material is deposited with the upper side of the web of fibre material on the nonwoven and the web of fibre material together with the nonwoven are transferred to the third circulating belt; and water jets arranged for bonding or entanglement of the web of fibre material and nonwoven on the third circulating belt.

The web of fibre material is thus transferred with its upper side to a circulating belt which is arranged upstream of the further downstream belt for hydroentanglement. Very lightweight fibre materials are thus supported and transferred to a belt, which is preferably arranged horizontally or sloping, from an upside down position, before the nonwoven is introduced into the installation and bonded with the fibre material. This upside down deposition allows the upper side of the fibre material to be bonded with the nonwoven, so that the flat lower side of the fibre material becomes the outer side of the product, the optical quality of which is improved.

The apparatus for introducing the nonwoven into the installation is preferably arranged between the belts. This provides a space-saving solution in which the fibre material is first deposited upside down on a further belt and can then be deposited with the upper side on the nonwoven, before the two are bonded together and entangled.

The arrangement of the apparatus for introducing the nonwoven in the region of a roll of the circulating belt has the advantage that the upper side of the web of fibre material is deposited on the nonwoven and the fibre material is compacted between the roll and the incoming nonwoven. This naturally requires the roll of the circulating belt to be arranged as a deflection roll around which the belt changes its direction. Due to the fact that the fibre material with the nonwoven is guided around the roll at a deflection angle, a first compression or compaction of the fibre material takes place. To that end, the nonwoven is introduced into the installation with a defined bias, in order to generate a minimal contact pressure on the fibre material.

In another embodiment, the apparatus for introducing the nonwoven into the installation can be in the form of an intake roll. Accordingly, an unwinding apparatus or a roller card can be integrated into the installation in a free spatial arrangement, it being possible for the nonwoven to enter the installation directly or indirectly by further rolls.

In another embodiment, the apparatus for introducing the nonwoven into the installation can be in the form of a suction drum, the suction drum advantageously being equipped with at least a first nozzle bar so that a first bonding or entanglement between the nonwoven and the fibre material can take place here.

The arrangement of the suction drum downstream of the roll in the material transport direction permits multi-stage bonding or entanglement of the fibre material with the nonwoven.

To that end, the suction drum can advantageously be arranged in the material transport direction between the first circulating belt and the downstream belt for the bonding/entanglement of the fibre material with the nonwoven, the fibre material being transferred with its upper side to the suction drum and the nonwoven being introduced into the installation in such a manner that the lower side of the fibre material can be bonded or entangled with the nonwoven by means of water jets. This alternative, together with the multi-stage entanglement, permits different variants in the surface structure of the end product.

In another embodiment the suction drum may be arranged in the material transport direction between the first circulating belt and the downstream belt for the bonding/entanglement of the fibre material with the nonwoven, the fibre material being transferred with its upper side to the suction drum and a nonwoven being introduced into the installation in such a manner that the upper side of the fibre material is bonded or entangled with the nonwoven by means of water jets.

In another embodiment, at least one water bar can be arranged inside the circulating belt on which the loose fibre material is deposited, in order to detach the web of fibre material from the belt.

The spacing between the circulating belt on which the loose fibre material is deposited and the belt on which the nonwoven is bonded with the fibre material by means of water jets is preferably greater than the thickness of the nonwoven with the fibre material deposited thereon. Compacting or enclosing between two belts is thereby avoided, since the two belts would then have to be exactly aligned and synchronised. This is precisely what the installation configuration according to the invention is intended to avoid.

According to another aspect of the invention, there is provided a method for the bonding or entanglement of a web of fibre material with a nonwoven by means of water jets, which in one embodiment provides that a web of fibre material can be deposited on a first circulating belt and that a nonwoven for bonding with the web of fibre material can be introduced into the installation, wherein the nonwoven and the web of fibre material can be bonded or entangled with one another on a further downstream circulating belt by means of water jets. In the method, first the web of fibre material is deposited on the nonwoven and then the fibre material together with the nonwoven is transferred to the further downstream belt for bonding or entanglement by means of water jets. Absolutely distortion-free bonding between the loose fibre material and the nonwoven is thereby possible, since the fibre material and the nonwoven are not compacted by two parallel belts which must run absolutely in parallel and synchronised with one another.

Especially in the case of very lightweight and short fibres, the web of fibre material can be transferred with its upper side to a circulating belt which is arranged upstream of the further downstream belt for hydroentanglement. The fibre material is thus first transferred upside down to the downstream belt and only then bonded with the nonwoven.

Another embodiment of method for bonding or entanglement of a web of fibre material with a nonwoven, comprises: depositing a web of fibre material on a first circulating belt of an installation for bonding and entanglement of a web of fibre material with a nonwoven, the web of material having an upper side remote from the first circulating belt; further depositing on a second circulating belt the web of fibre material from the first circulating belt with the upper side of the web of the fibre material facing the second circulating belt; introducing the nonwoven into the installation between the second circulating belt and a third circulating belt arranged downstream of the second circulating belt; transferring the web of fibre material together with the nonwoven to the third circulating belt; and bonding or entangling the nonwoven and the web of fibre material with one another on the third circulating belt by water jets.

BRIEF DESCRIPTION OF THE DRAWINGS

The invention is explained by means of the accompanying drawings, in which.

DETAILED DESCRIPTION OF THE INVENTION

Figure 1:
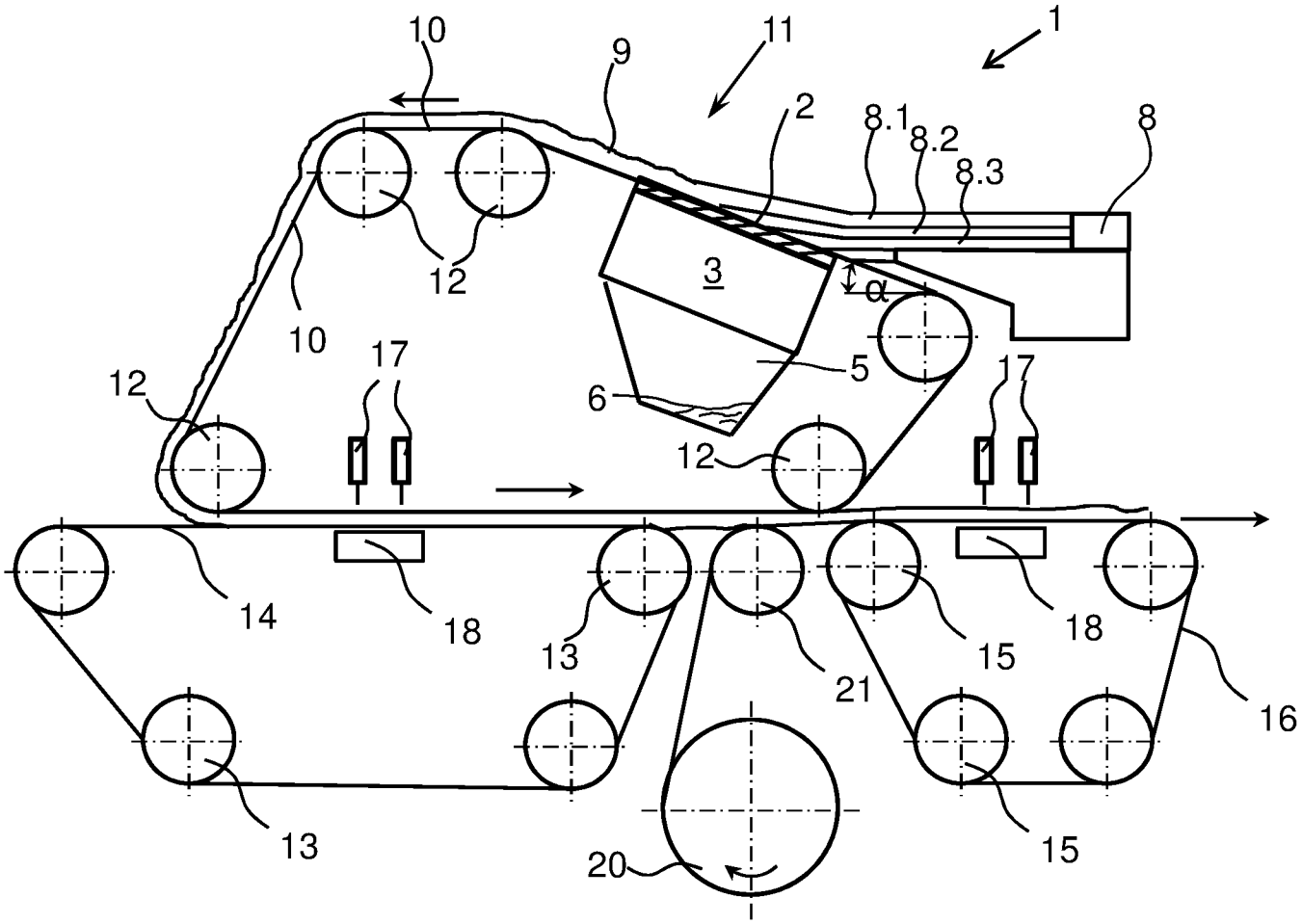
FIG. 1: is a first embodiment of the installation according to the invention and of the method.

An inclined wire former 1 is arranged beneath a circulating filter belt 10. The filter belt 10, which can be in the form of an endless belt, passes around various rolls 12 and has a sloping portion 11 which ascends at the angle $\alpha$ in the running direction of the filter belt. The inclined wire former 1, on the covering 2 of which the filter belt 10 is supported, is arranged in the region of the sloping portion 11, beneath the filter belt 10. Beneath the covering 2 there is arranged at least one suction zone 3 which is placed under low pressure by means of pumps (not shown). The inclined wire former 1 can have a plurality of suction zones 3 which are subjected to different pressures or low pressures. The low pressure sources can preferably be in the form of controllable/adjustable vacuum pumps.

In this exemplary embodiment, three fibre suspensions 8.1, 8.2 and 8.3 arranged one above the other are applied to the filter belt 10 via a headbox 8. Each fibre suspension 8.1, 8.2 and 8.3 contains, in addition to water, a specific amount of solid material, which in turn consists of fibres and other added materials. Between the fibre suspensions 8.1, 8.2 and 8.3 there are arranged baffles (not shown), with which the layer thickness of the fibre suspensions can be varied individually or in total. Since the baffles separate the fibre suspensions 8.1, 8.2 and 8.3 from one another, the fibre suspensions are dewatered on the inclined wire former 1 one after the other. Mixing of the fibre suspensions 8.1, 8.2 and 8.3 is thereby prevented and the ply purity of the individual layers of fibre material is improved. Via the at least one suction zone in conjunction with the controllable/adjustable vacuum pumps, each layer of a fibre suspension 8.1, 8.2 and 8.3 can be exposed to a separate low pressure, whereby different mixtures of water with fibres in each fibre suspension can be processed.

In this exemplary embodiment, the fibre suspensions 8.1 and 8.3, which on further processing form the outer layers or the cover layer for the middle layer of fibre suspension 8.2, can consist at least in part of short synthetic fibres such as, for example, polyester, polyamide or polyolefin. Fibre mixtures of synthetic and natural fibres are also possible. The outer layers can likewise also consist of 100% pulp. The middle fibre suspension can consist of natural fibres, which have a high water retention capacity.

The thickness of the plies is adjustable by the baffles by varying the delivery of the fibre suspensions 8.1, 8.2 and 8.3 via the headbox 8. In the case of a sandwich nonwoven, for example, plies of equal thickness can be produced, or the plies can be produced with a graduation of, for example, 10%, 80% and 10% thickness. The weight per unit area of each ply of fibre material 9 can indirectly also be adjusted thereby.

It is of course also possible to deliver only one fibre suspension, so that a single ply of fibres forms after the removal of water.

The filter belt 10, which is permeable to liquids and gases, transports the fibre suspensions 8.1, 8.2 and 8.3 arranged one above the other over the sloping portion 11 over the inclined wire former 1. Owing to gravity and the low pressure acting on the fibre suspensions 8.1, 8.2 and 8.3, the fibre suspensions are dewatered, whereby in this example a web of fibre material 9 having three plies of fibres is formed.

The web of fibre material 9 is transported on the belt 10 in the direction indicated by the arrow, first over a horizontal portion and then further over a descending sloping portion. After the descending sloping portion, the web of fibre material 9 is transferred upside down, around a roll 12, onto a further circulating belt 14, which is likewise guided around a plurality of rolls 13. The belts 10 and 14 run approximately parallel at least in part, the spacing between the belts 10, 14 being greater than the thickness of the web of fibre material 9. Alternatively, the belts 10, 14 can also be arranged with such a spacing that the web of fibre material 9 is compressed. In the region in which the belts 10 and 14 run parallel there is arranged inside the circulating belt 10 at least one water bar 17 with which the web of fibre material 9 is pre-entangled and detached from the belt 10. The associated suction means 18 is situated inside the circulating belt 14. Downstream in the material running direction of the fibre material 9 and beneath the inclined wire former 1 with the circulating belt 10 there is arranged a further circulating belt 16 on which the web of fibre material 9 is processed further. The circulating belt 16 is so arranged that it does not overlap with or run parallel to the belt 10. Between the belts 14 and 16 there is arranged an intake roll 21 by which a nonwoven 20 is introduced onto the circulating belt 16 beneath the web of fibre material 9. Since the web of fibre material 9 is transported further by the circulating belt 10 downstream of the descending sloping portion upside down, the upper side of the web of fibre material 9 is deposited on the nonwoven 20. In this exemplary embodiment, the nonwoven 20 is unwound from a store or a roll of material. Alternatively, it is also possible to arrange in place of the roll of nonwoven a roller card by means of which the nonwoven 20 is introduced directly into the entanglement installation shown in FIG. 1. The spacings between the rolls 13, 21 and 15 are on the one hand kept small in order to minimise the nip for the further transport of the fibre material 9; on the other hand, the intake roll 21 can be adjustable, in order to introduce the nonwoven 20 quickly. Final bonding between the nonwoven 20 and the fibre material 9 takes place in the region of the belt 16 by bonding of the fibre material 9 with the nonwoven 20 by means of at least one water bar 17 and compression. The water jet of the water bar 17 thereby strikes the fibre material 9, which is bonded with the nonwoven 20.

Figure 2:
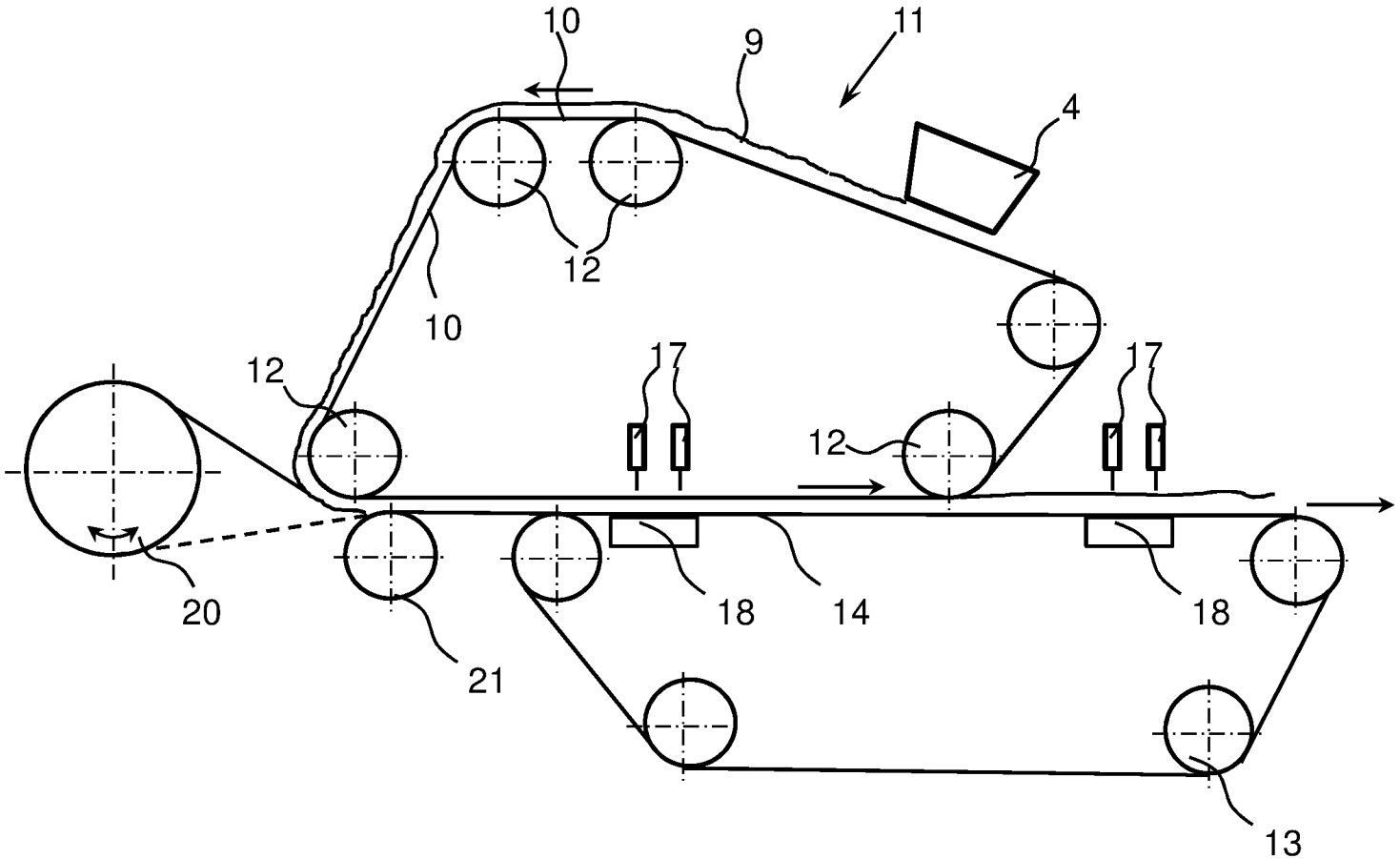
FIG. 2: is a second embodiment of the installation according to the invention and of the method.

FIG. 2 shows a circulating belt 10 in which there is arranged above a sloping portion 11 a fibre applicator 4 with which pulp, for example, is delivered as loose fibres. Unlike the exemplary embodiment of FIG. 1, it is here possible to process not only wet-laid fibres but also dry fibres. The web of fibre material 9 is transported further in the material flow direction over a horizontal portion to a descending sloping portion and is transferred upside down onto a nonwoven 20 by a roll 12. In order that the dry fibres do not slip off the belt 10 it is possible, for example, to arrange a fibre wetting means (not shown) on the horizontal portion of the belt 10, so that the loose assembly of dry fibres acquires a certain degree of cohesiveness.

In this exemplary embodiment, the nonwoven 20 can likewise be unwound from a roll or supplied directly from a roller card. The web of fibre material 9 with the nonwoven 20 are guided around the roll 12 at a deflection angle, whereby a first compression or compaction of the fibre material takes between the roll 12 and nonwoven and there is a first compacting or bonding between the nonwoven 20 and the web of fibre material 9. This bonding is enhanced on a downstream belt 14 by at least one water bar 17. The downstream belt 14 is arranged beneath the belt 10 and runs parallel thereto at least in part. The spacing between the belts 10, 14 is greater than the thickness of the nonwoven 20 with the web of fibre material 9. Alternatively, the nonwoven 20 can also be delivered onto the belt 14 by an intake roll 21, the web of fibre material 9 being deposited upside down on the nonwoven 20 in the region of the intake roll 21.

Figure 3:
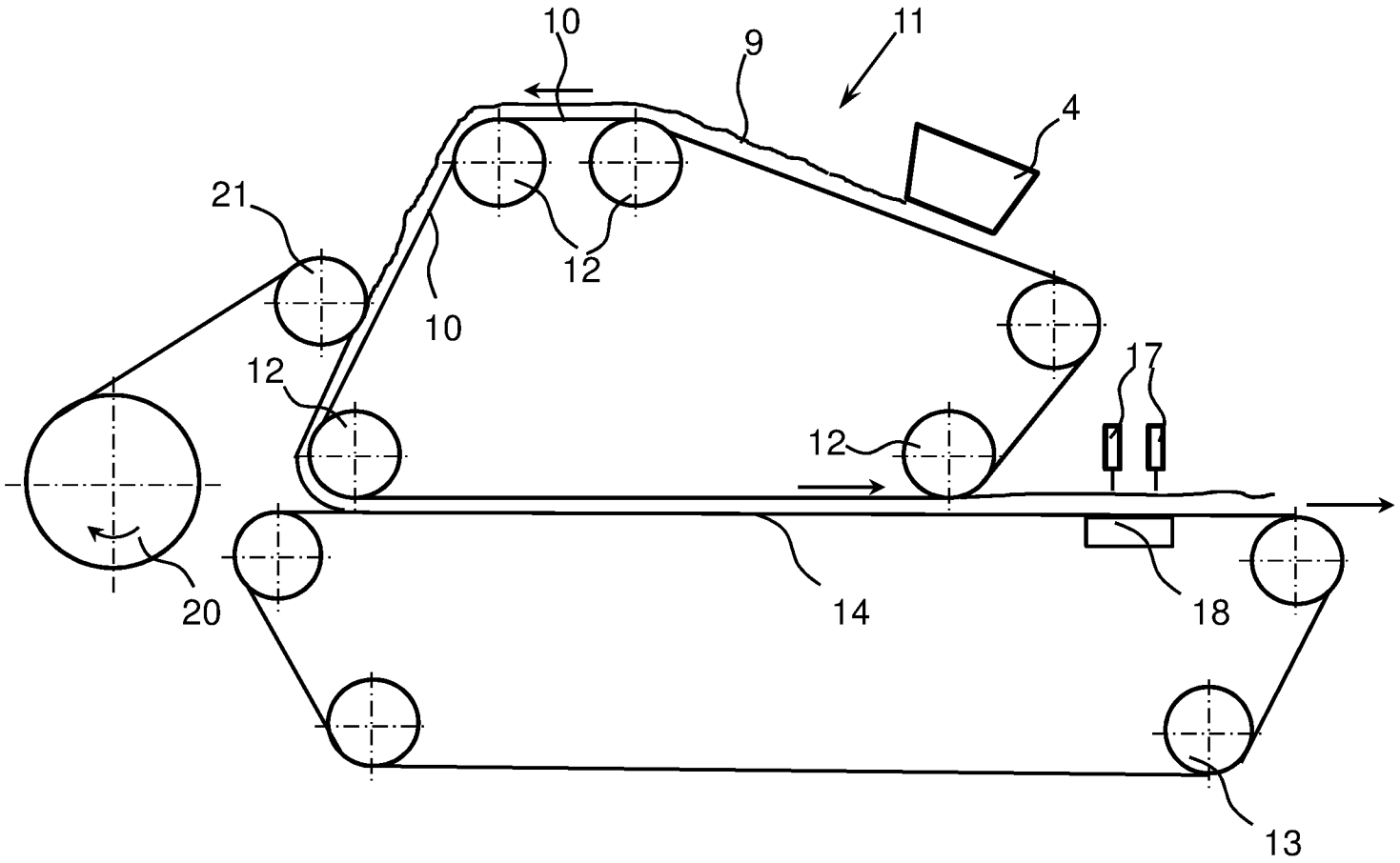
FIG. 3: is a third embodiment of the installation according to the invention and of the method.

The exemplary embodiment of FIG. 3 likewise shows two circulating belts 10, 14 which are arranged in parallel at least in part, the circulating belt 14 being arranged beneath the belt 10. Here too, a web of fibres is delivered onto the belt 10 via a fibre applicator 4 or via an inclined wire former 1. In the region of a descending sloping portion of the belt 10 there is arranged an intake roll 21 by which a nonwoven 20 is applied to the web of fibre material 9. By means of a downstream roll 12, with which the web of fibre material 9 and the nonwoven 20 are deflected onto an approximately horizontal belt 14, compacting between the nonwoven 20 and the fibre material 9 takes place, even though the spacing between the belts 10, 14 is greater than the thickness of the nonwoven 20 with the fibre material 9. Only when the nonwoven 20 with the fibre material 9 has left the region between the belts 10, 14 and is lying only on the belt 14 does final entanglement between the nonwoven 20 and the fibre material 9 take place by means of at least one water bar 17. An associated suction means 18 is arranged inside the circulating belt 14.

Figure 3A:
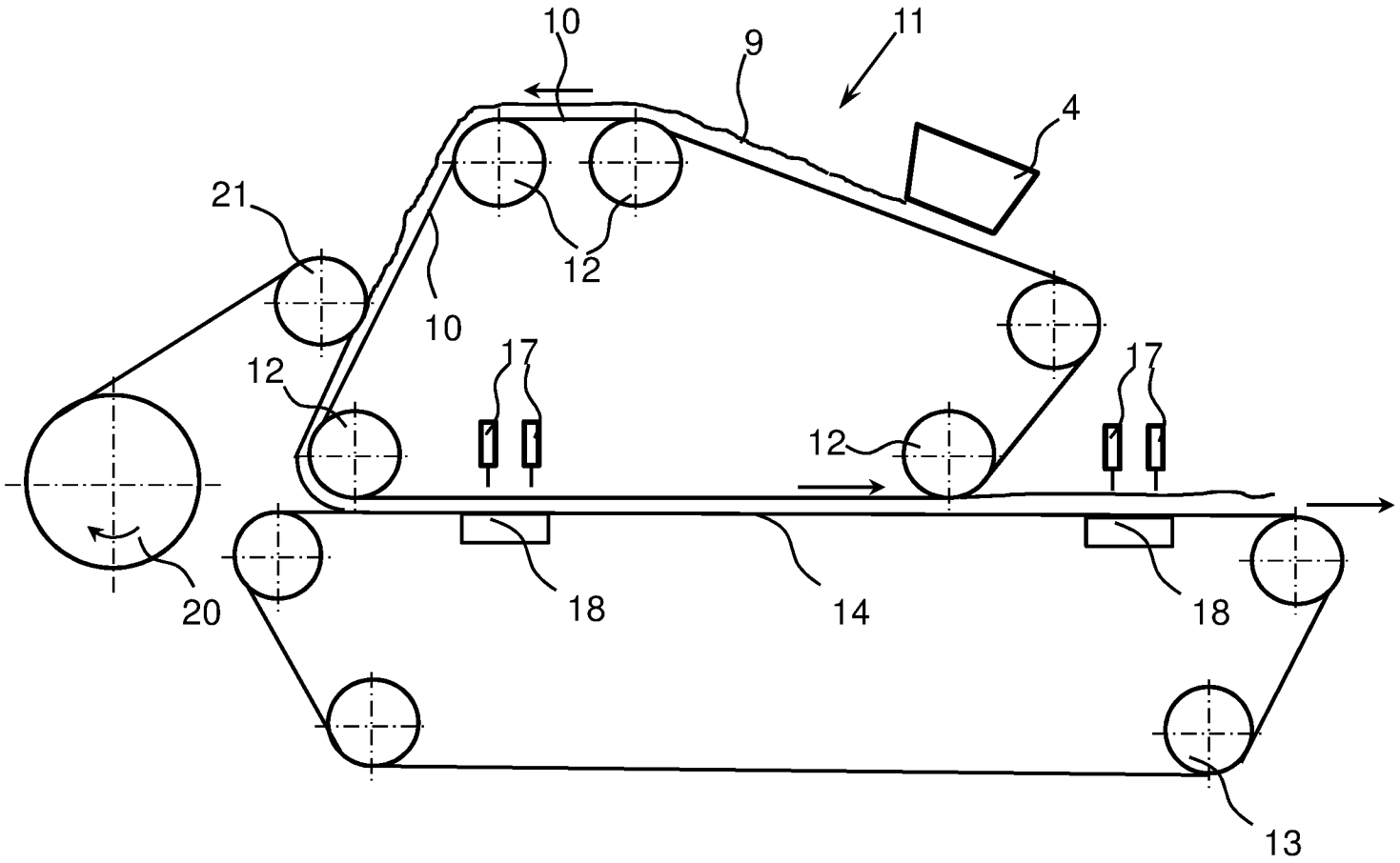
FIG. 3*a*: is a further variant of the third embodiment.

A further variant in FIG. 3*a* shows in a further arrangement at least one water bar 17 inside the belt 10, whereby the web of fibre material 9 is detached from the belt 10. Compacting does not take place at this point because the spacing between the belts 10, 14 is greater than the thickness of the nonwoven 20 with the fibre material 9.

Figure 3B:
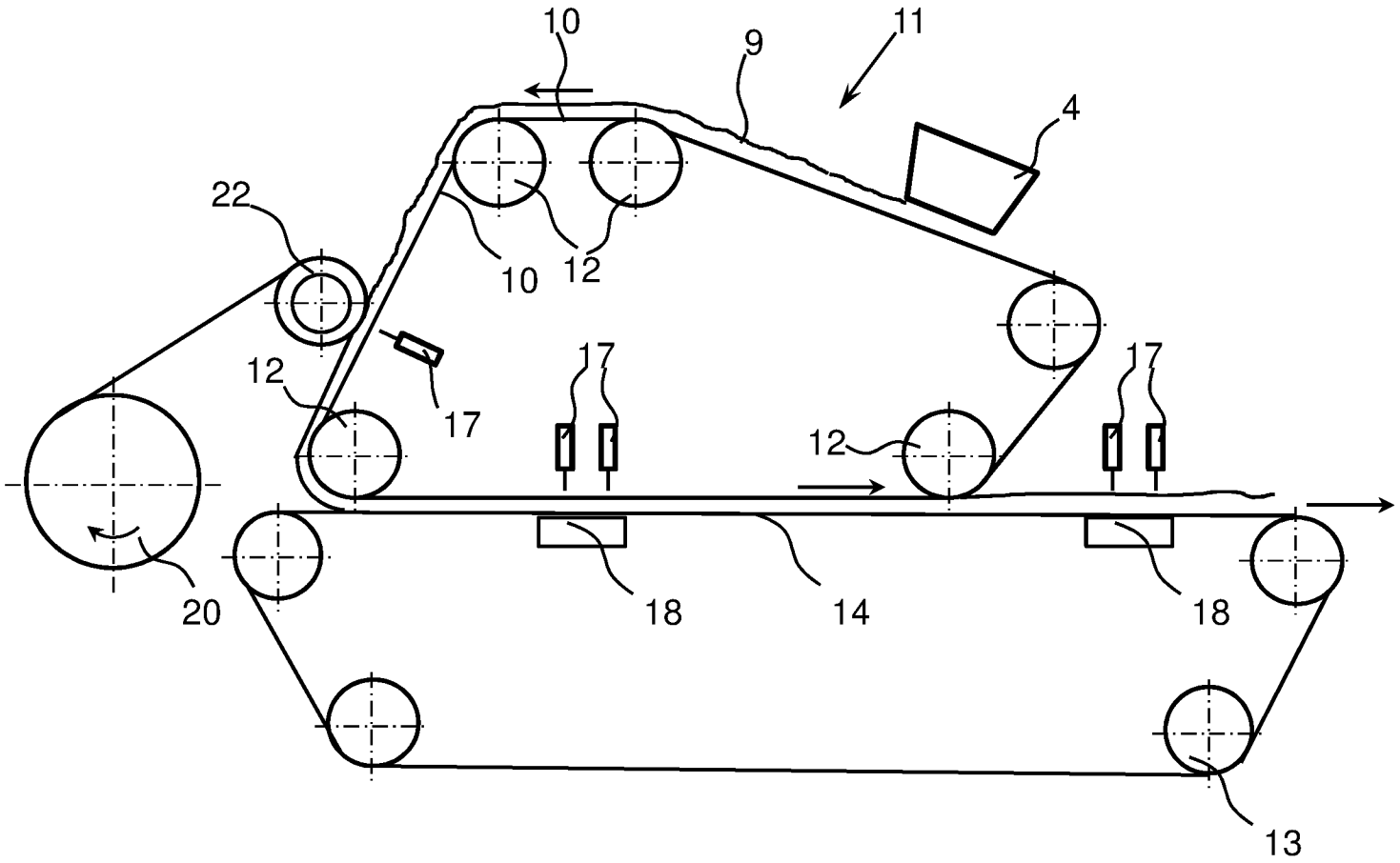
FIG. 3*b*: is a further variant of the third embodiment.

The exemplary embodiment in FIG. 3*b* shows instead of the intake roll 21 a suction drum 22 which is acted upon by at least one water bar 17. This effects entanglement of the web of fibre material 9 with the nonwoven 20, compacting between the nonwoven 20 and the fibre material 9 then taking place as a result of the deflection around the roll 12. The downstream water bars 17 inside the belt 10 likewise ensure complete detachment of the fibre material 9 from the belt 10, since here too the spacing between the belts 10, 14 is greater than the thickness of the nonwoven 20 with the fibre material 9. The downstream further entanglement between the nonwoven 20 and the web of fibre material 9 takes place in a region on the belt 14 in which the belts 10, 14 are no longer running in parallel.

Figure 4:
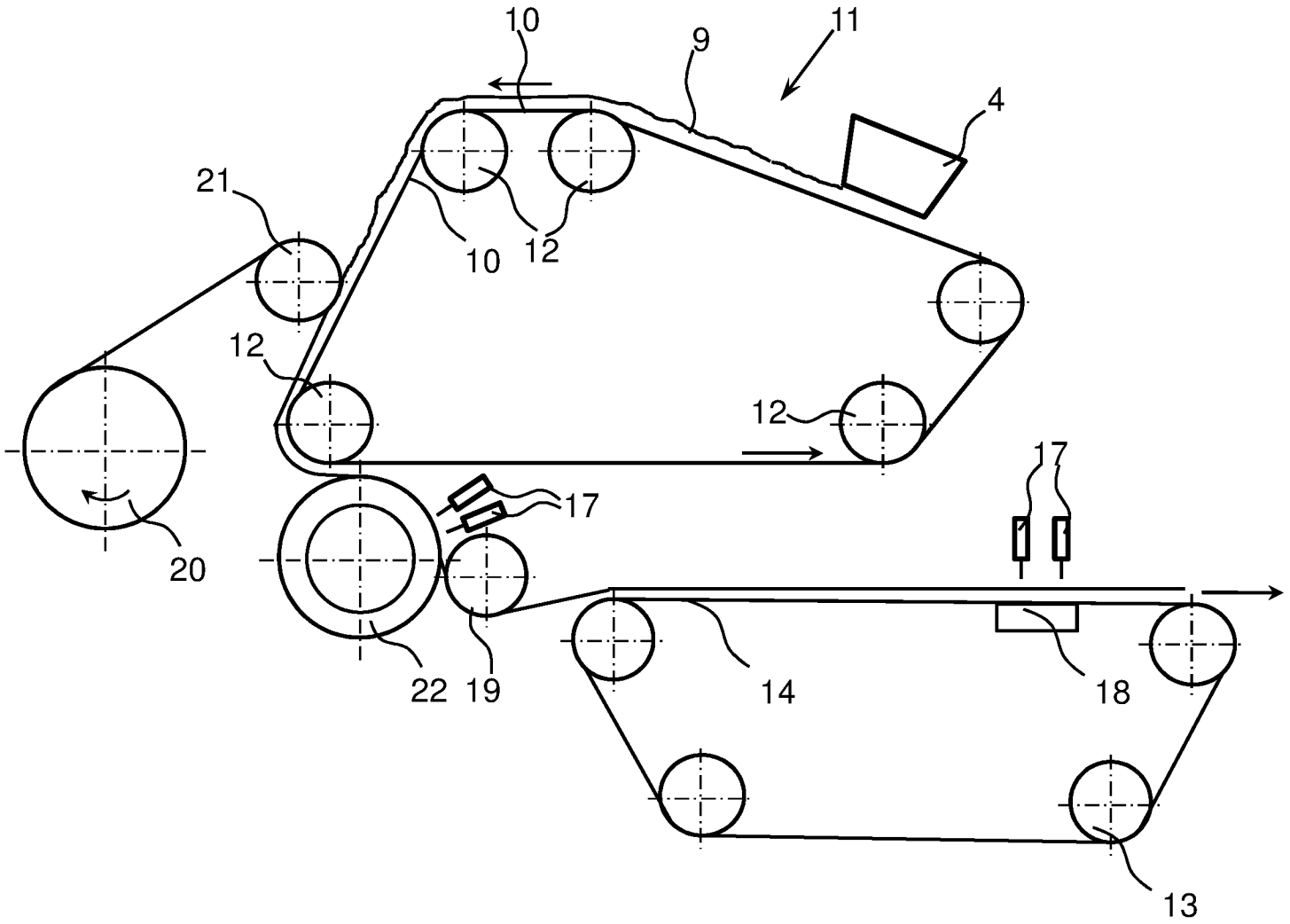
FIG. 4: is a fourth embodiment of the installation according to the invention and of the method.

The exemplary embodiment of FIG. 4 likewise shows in the region of a descending portion an intake roll 21 around which a nonwoven 20 is brought into contact with the web of fibre material 9. By subsequent deflection by a roll 12, compacting between the nonwoven 20 and the web of fibre material 9 takes place. Instead of being deposited directly on a belt 14 arranged beneath the belt 10, the nonwoven 20 with the web of fibre material 9 is guided at least in part around a suction drum 22, on which the nonwoven 20 is entangled with the fibre material 9 by means of water bars 17. Further transport to a circulating belt 14 having at least one further downstream water bar 17 is effected by a downstream roll 19.

Figure 5:
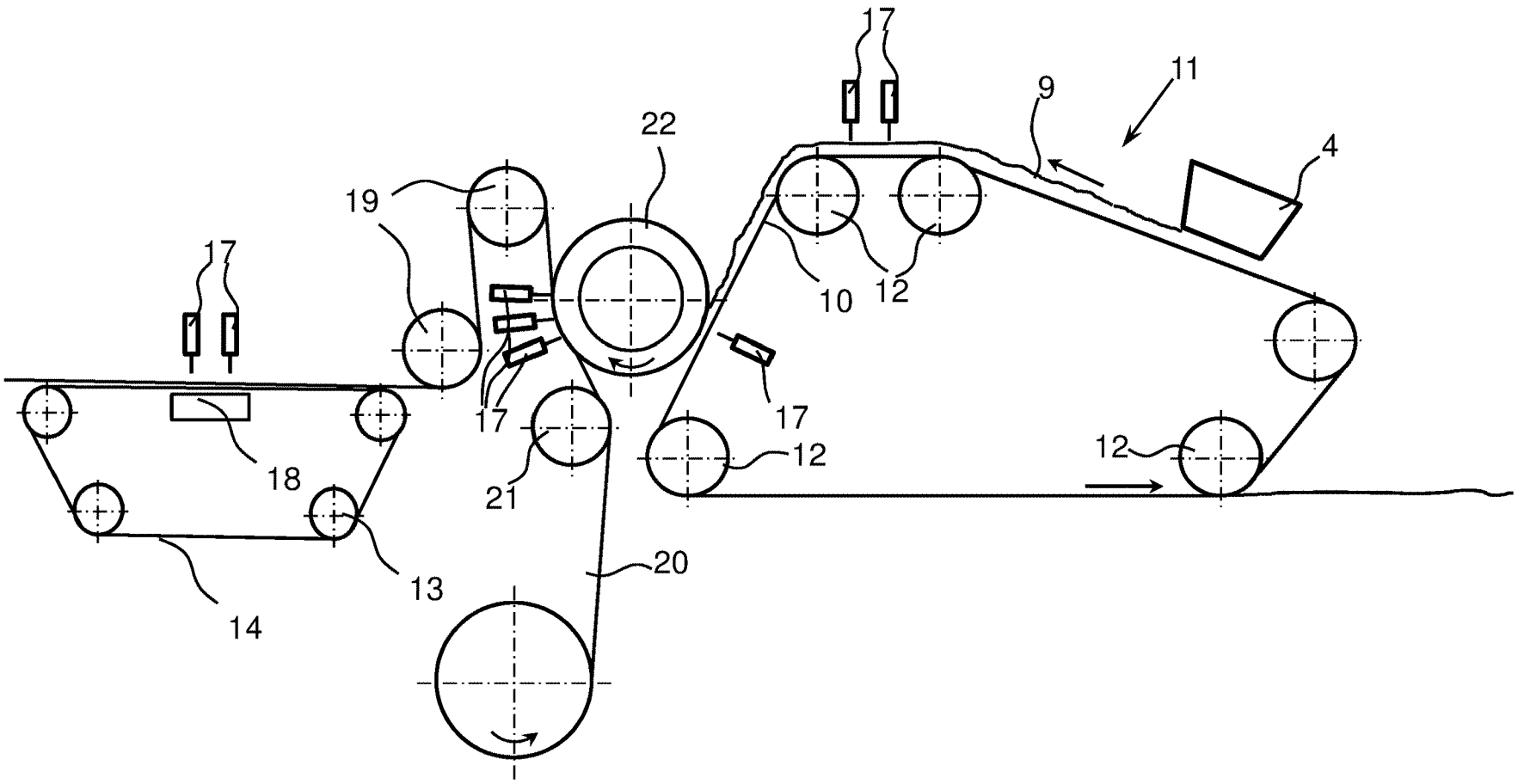
FIG. 5: is a fifth embodiment of the installation according to the invention and of the method.

In the exemplary embodiment of FIG. 5, the fibres 9 deposited on the belt 10 are entangled by means of water bars 17 in the first horizontal portion. In the region of the descending portion, the entangled fibre material 9 is detached from the belt 10 by a water bar 17 and transferred with its upper side to the suction drum 22 and guided around the drum. In this exemplary embodiment, the suction drum 22 rotates clockwise. Beneath the suction drum 22 a nonwoven 20 is supplied by an intake roll 21, so that bonding between the nonwoven 20 and the lower side of the fibre material 9 takes place over a portion of the periphery of the suction drum 22, at least one water bar 17 bonding the fibre material and the nonwoven with one another. Downstream rolls 19 effect further transport to a further circulating belt 14 on which the nonwoven 20 is again bonded with the fibre material 9 by means of water bars 17.

Figure 6:
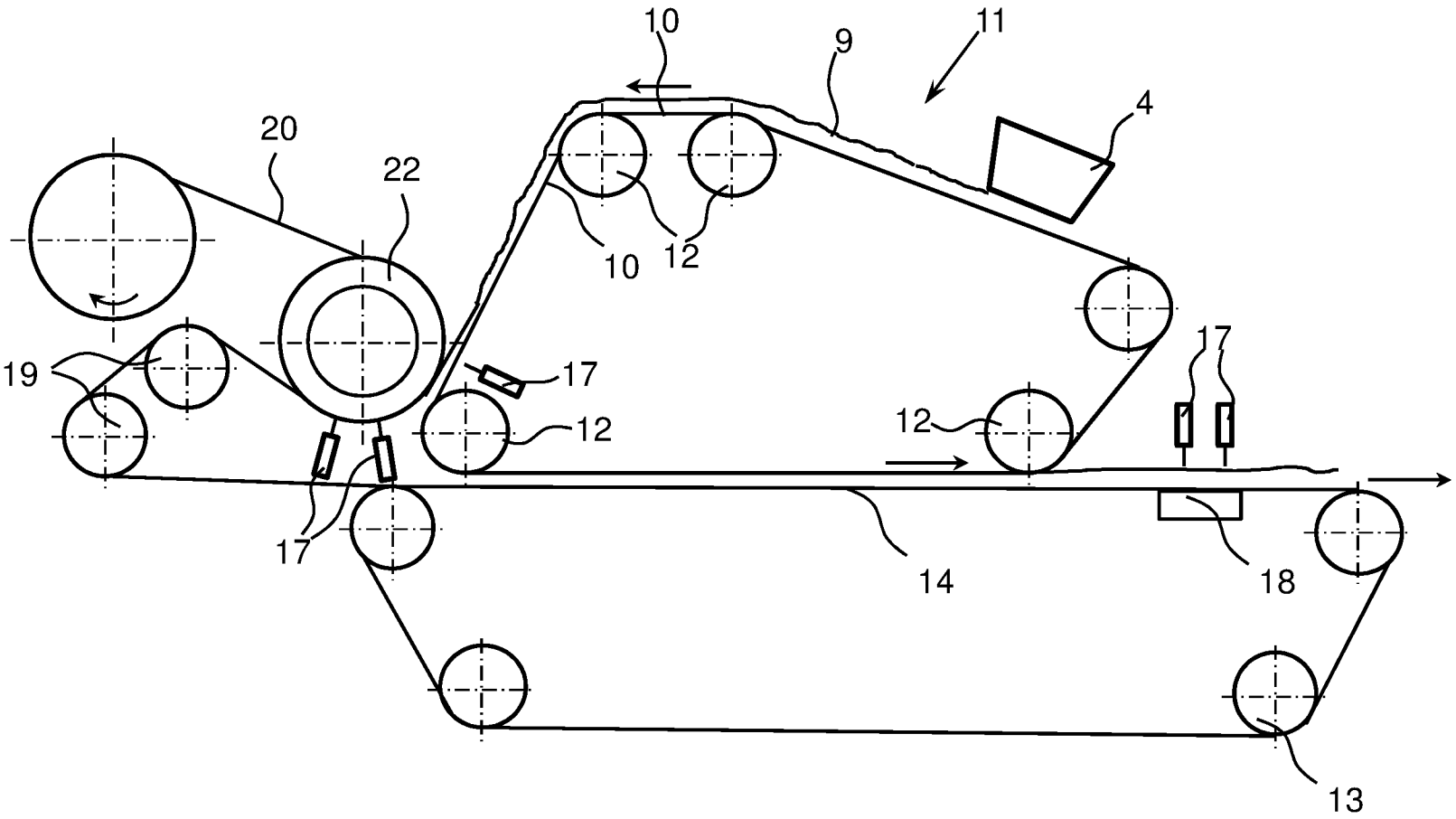
FIG. 6: is a sixth embodiment of the installation according to the invention and of the method.

In the exemplary embodiment of FIG. 6 too, a suction drum 22 is arranged in the region of the descending portion. A nonwoven 20 is guided around the suction drum 22. The fibre material 9 is detached from the belt 10 in the region of the point of contact between the fibre material 9 and the suction drum 22. The fibre material 9 is thereby situated beneath the nonwoven 20 and is entangled with the nonwoven 20 with its upper side by means of water bars 17 on the following periphery of the suction drum 22. Rolls 19 arranged downstream effect transfer to a further circulating belt 14, which can be arranged beneath the belt 10, it being possible for further entanglement between the nonwoven 20 and the fibre material 9 to take place subsequently by means of water bars 17.

It is common to all the exemplary embodiments that the fibres are deposited on the first belt 10 in the form of loose pulp or wet-laid by means of an inclined wire former 1. The nonwoven 20 can be supplied to the installation as a card web from a supply roll or it can be supplied to the installation directly as a roller card web from a roller card. The nonwoven 20 can be produced from short or endless fibres. Furthermore, the bonding of the fibre material 9 with the nonwoven 20 does not take place in a region in which two belts are guided in parallel. Thus, unlike in the prior art, the loose fibres do not have to be bonded with the nonwoven upside down between two belts. Alignment of the belts with one another and synchronisation of the belts speeds are thus not necessary. Although it is possible after the first bonding between the nonwoven 20 and the fibre material 9 to compact the two plies by means of belts arranged in parallel, this is not necessary for the method and the installation. The water bars generate twisting and thus entanglement of the fibres with one another by means of the high-pressure water jets or, at a lower pressure, serve to detach the fibres or the nonwoven from a belt or a drum.

The invention claimed is:

1. An installation for bonding or entanglement of a web of fibres, comprising:

a first circulating belt having a roll and being arranged for depositing a web of fibre material thereon, the web of fibre material having an upper side remote from the first circulating belt;

a further circulating belt arranged downstream of the first circulating belt;

an apparatus for introducing a nonwoven into the installation arranged in a region of the roll of the first circulating belt; wherein the roll of the first circulating belt is arranged so that the web of fibre material and the nonwoven are guided around the roll at a deflection angle so that a compaction of the web of fibre material takes place between the roll and the nonwoven, and the nonwoven together with the web of fibre material are transferred to the further circulating belt; and at least one water bar for producing water jets arranged for bonding or entanglement of the web of fibre material and the nonwoven on the further circulating belt.

2. The installation according to claim 1, wherein the apparatus for introducing the nonwoven into the installation includes a further roll.

3. The installation according to claim 1, further including at least one water bar arranged inside the first circulating belt to detach the web of fibre material from the first circulating belt.

4. The installation according to claim 1, wherein a spacing between the first circulating belt and the further circulating belt is greater than a thickness of the nonwoven with the fibre material deposited thereon.

5. A method for bonding or entanglement of a web of fibre material with a nonwoven, comprising;

depositing a web of fibre material on a first circulating belt of an installation for bonding or entanglement of the web of fibre material with a nonwoven, the web of material having an upper side remote from the first circulating belt;

introducing into the installation an incoming nonwoven in a region of a roll of the first circulating belt so that the upper side of the web of fibre material is deposited on the incoming nonwoven, wherein the introducing includes guiding the nonwoven and the web of fibre material around the roil at a deflection angle so that there is a compacting of the web of fibre material between the roll of the first circulating belt and the incoming nonwoven;

subsequently transferring the nonwoven together with the web of fibre material to a further circulating belt arranged downstream of the first circulating belt; and bonding or entangling the web of fibre material and the nonwoven on the further circulating belt by water jets.

6. The method according to claim 5, wherein the introducing step includes introducing the incoming nonwoven into the installation via a second roll.

* * * * *